US006494438B1

(12) United States Patent
Noirot et al.

(10) Patent No.: US 6,494,438 B1
(45) Date of Patent: Dec. 17, 2002

(54) PLASTIC PORCH OR DECK RAILING SYSTEMS AND COMPONENT PARTS THEREOF

(75) Inventors: Nicholas N. Noirot, Erie, PA (US); John S. Schatz, West Springfield, PA (US)

(73) Assignee: CW Ohio, Inc., Conneaut, OH (US)

( * ) Notice: Subject to any disclaimer, the term of this patent is extended or adjusted under 35 U.S.C. 154(b) by 0 days.

(21) Appl. No.: 09/315,080

(22) Filed: May 19, 1999

(51) Int. Cl.[7] ..... E04H 17/14

(52) U.S. Cl. ..... 256/59; 256/19; 256/22; 256/60; 256/65; 256/66; 256/67; 256/68

(58) Field of Search ..... 256/59, 65, 19, 256/60, 66, 22, 67, 68

(56) References Cited

U.S. PATENT DOCUMENTS

| | | | | | |
|---|---|---|---|---|---|
| 2,833,522 | A | * | 5/1958 | Michaels | 256/65 |
| 3,700,213 | A | * | 10/1972 | Blease | 256/19 |
| 4,014,520 | A | * | 3/1977 | Walters | 256/22 |
| 4,344,604 | A | * | 8/1982 | Basey | |
| 4,403,767 | A | * | 9/1983 | Basey | |
| 5,056,283 | A | * | 10/1991 | Sapinski | |
| 5,613,664 | A | * | 3/1997 | Svalbe | 256/19 |
| 5,626,331 | A | * | 5/1997 | Erwin | 256/19 |
| 5,876,021 | A | * | 3/1999 | Spence et al. | 256/19 |
| 5,967,498 | A | * | 10/1999 | Junell | 256/19 |
| 6,015,138 | A | * | 1/2000 | Kohlberger | 256/65 |
| 6,017,019 | A | * | 1/2000 | Erwin | 256/65 |
| 6,029,954 | A | * | 2/2000 | Murdaca | 256/59 |
| 6,053,480 | A | * | 4/2000 | De Guise | 256/59 |

* cited by examiner

*Primary Examiner*—Lynne H. Browne
*Assistant Examiner*—Ryan M. Flandro
(74) *Attorney, Agent, or Firm*—Renner, Otto, Boisselle & Sklar, LLP

(57) ABSTRACT

Plastic railing systems include extruded hollow fiberglass reinforced top and bottom rail sections and newel posts, and hollow plastic balusters having locking tabs on one end adapted to be snap locked into mounting holes in a bottom wall of the top rail section. The locking tabs are retained within the mounting holes by retaining lips protruding from a front edge of the locking tabs into overlying relation with an inner surface of the bottom wall of the top rail section surrounding the holes. At the bottoms of the balusters are dowels that are adapted to be received in predrilled holes in a top wall of the bottom rail section and secured in place as by driving fasteners through predrilled pilot holes in a bottom wall of the bottom rail section into the dowels. Rake balusters are made by filling the balusters with a rigid high density plastic foam material and cutting off the ends of the balusters at the desired rake angle for attachment to the top and bottom rail sections using suitable fasteners. The lower end portions of the newel posts are filled with a rigid high density plastic foam that permits the posts to be mounted to any type of floor surface using the same basic mounting methods used to attach wood newel posts to such floor surface.

29 Claims, 6 Drawing Sheets

PLASTIC PORCH OR DECK RAILING SYSTEMS AND COMPONENT PARTS THEREOF

FIELD OF THE INVENTION

This invention relates generally to plastic railing systems for installation around porches and decks and the like and to the different component parts of such railing systems.

BACKGROUND OF THE INVENTION

Plastic porch or deck railing systems are generally known. A major advantage plastic porch or deck railing systems have over wood railing systems is that plastic railing systems are impervious to insect attack and fungus and won't rot or decay. Also, if properly designed, plastic railing systems won't warp, twist or split, and are virtually maintenance free.

However, there is a need for plastic railing systems that are quicker to install than previous known railing systems. Also, there is a need for improved concealed attachments between various plastic component parts of the railing systems. In addition, there is a need to be able to mount extruded plastic newel posts for such railing systems to different floor surfaces using the same basic mounting methods used to attach newel posts made out of wood.

SUMMARY OF THE INVENTION

The plastic railing systems of the present invention are easy to install and include concealed attachments between most plastic component parts. Also, the railing systems include extruded hollow fiberglass reinforced plastic newel posts that may be installed on any type of floor surface using substantially the same basic mounting methods used to attach wood newel posts to the same type of floor surface.

In accordance with one aspect of the invention, a concealed snap-lock attachment is provided between the tops of the balusters and top rail sections of the plastic railing systems for ease of assembly.

In accordance with another aspect of the invention, the bottoms of the balusters may be secured in predrilled holes in the bottom rail sections using available screws.

In accordance with another aspect of the invention, hollow plastic rake balusters may easily be attached to plastic top rail sections using flexible fillet strips for angled installations on stairs.

In accordance with another aspect of the invention, the ends of the rail sections may easily be attached to newel posts using concealed attachment blocks.

In accordance with another aspect of the invention, the lower end portions of hollow extruded plastic newel posts are filled with a rigid high density plastic foam that permits the posts to be mounted to any type of floor surface using the same basic mounting methods used to attach wood newel posts to such floor surfaces.

These and other aspects, objects, advantages and features of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE PREFERRED EMBODIMENTS

Figure 1:
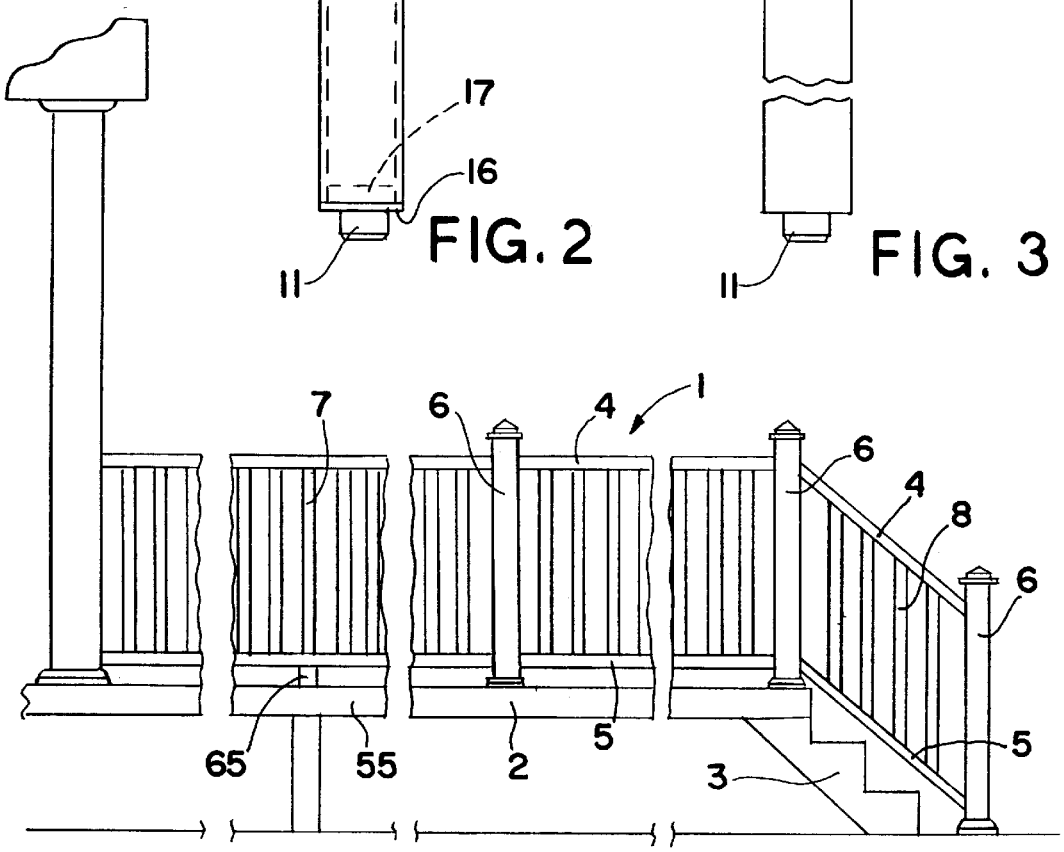
FIG. 1 is a fragmentary schematic side elevation view of a preferred form of plastic railing system in accordance with this invention mounted along one side of a porch or deck and down a flight of stairs.

Referring now in detail to the drawings and initially to FIG. 1, a preferred form of railing system 1 in accordance with this invention is shown installed along one side of a porch or deck 2 and down a flight of stairs 3. Railing system 1 includes top/hand and bottom/shoe rails 4 and 5 and newel posts 6 which may be coextruded out of a suitable thermoplastic material such as ABS (acrylonitrile butadiene styrene polymer) containing relatively long glass fibers for increased strength. The outer skin of the various component parts may be a coextrusion for example of PVC (polyvinyl chloride) to give the component parts a smooth glossy surface finish that requires no finishing but may be painted different colors if desired. Extending vertically between the top and bottom rails 4 and 5 are hollow plastic balusters 7 that may either be plain square balusters extruded out of a suitable thermoplastic material such as PVC or colonial style balusters injection molded out of a suitable thermoplastic material such as PVC. Where the railing system is installed on stairs, rake balusters 8 may be formed by filling the hollow plastic balusters 7 with a rigid plastic foam such as rigid high density (e.g., 20 lb. density) polyurethane foam and subsequently cutting off the ends at the desired rake angle for angled installation to the angled top and bottom rails as described hereafter.

Figure 2:
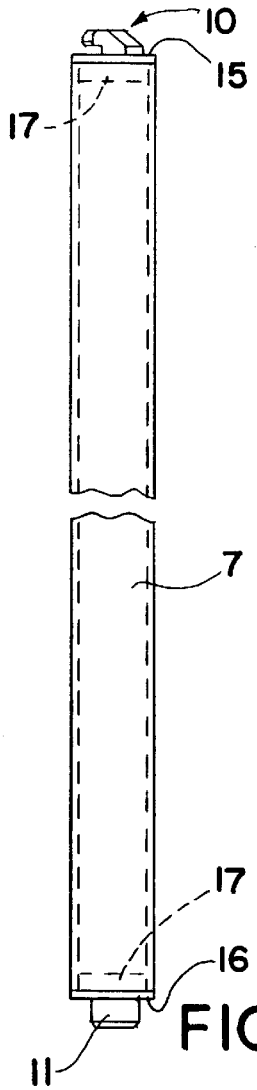
FIG. 2 is an enlarged fragmentary side elevation view of an extruded hollow plastic baluster for the plastic railing systems of the present invention having a plain square profile.
Figure 3:
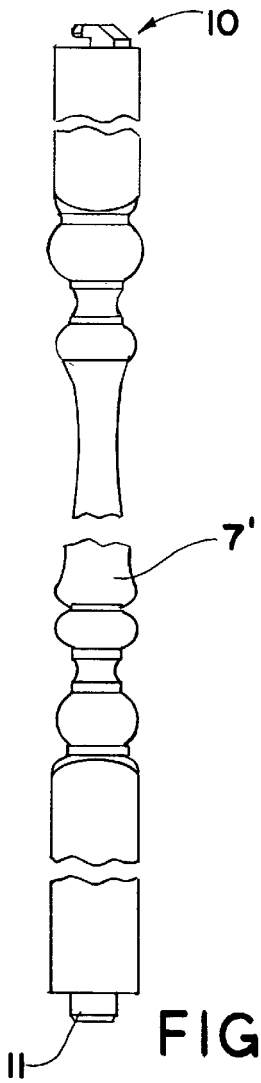
FIG. 3 is an enlarged fragmentary side elevation view of a gas assisted injection molded baluster for such plastic railing systems having a traditional colonial profile.

FIGS. 1 and 2 show extruded balusters 7 having plain square profiles, whereas FIG. 3 shows a gas-assisted injection molded baluster 7' having a traditional colonial profile. The gas assisted injection molded balusters 7' are made to a desired length, for example, 32 inches or 36 inches, and are hollow except at the ends. One end has an integral molded locking tab 10 to provide a snap lock attachment to the top rails 4, whereas the other end has an integral molded dowel 11 to facilitate attachment to the bottom rails 5 as described hereafter.

The extruded plain square balusters 7 may be cut to any finish length desired and the open ends closed as by inserting injection molded end caps 15 and 16 within such open ends. End caps 15 have locking tabs 10 thereon similar to the locking tabs on one end of the injection molded balusters 7', whereas the other end caps 16 have dowels 11 injection molded thereon. Both end caps 15 and 16 have flanges 17 adapted to be received within the open ends of the extruded balusters 7 and secured in place as by solvent welding the end caps to the ends of the balusters 7 as schematically shown in FIG. 2.

Predrilled holes 20 are provided in the bottom wall 21 of the top/hand rails 4 (see FIGS. 4–6) for snap locking the locking tabs 10 on the balusters 7, 7' into such holes. For safety reasons local building codes typically require that the hole locations on the rails be such that the baluster spacing will not permit a four inch diameter ball to pass through the openings between the balusters when installed.

The locking tabs 10, which are shown in greater detail in FIGS. 8 through 11, are sized and shaped to permit retaining lips 22 on the locking tabs to be easily inserted into the predrilled holes 20 in the top rails 4 at an angle and then snapped into place, leaving very little play between the locking tabs and surrounding hole walls. At the same time, enough surface contact is provided between the retaining lips 22 on the locking tabs 10 and the inner surface 23 of the bottom wall 21 of the top rails surrounding the holes 20 to meet local building code requirements for withstanding a minimum required uplifting force on the top rails (e.g., 200 pounds), without breaking the locking tabs or causing the locking tabs to pull out of the holes.

Figure 8:
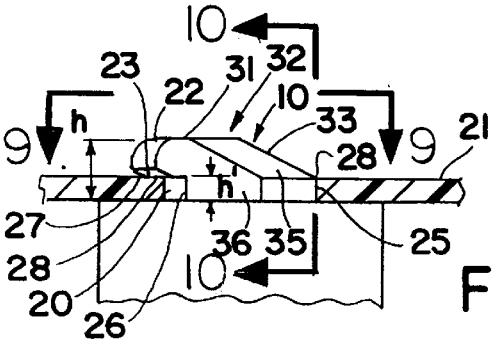
FIG. 8 is a further enlarged fragmentary side elevation view, partly in section, showing the snap-lock connection between the top of the baluster and the bottom wall of the top rail section shown in FIG. 4.
Figure 9:
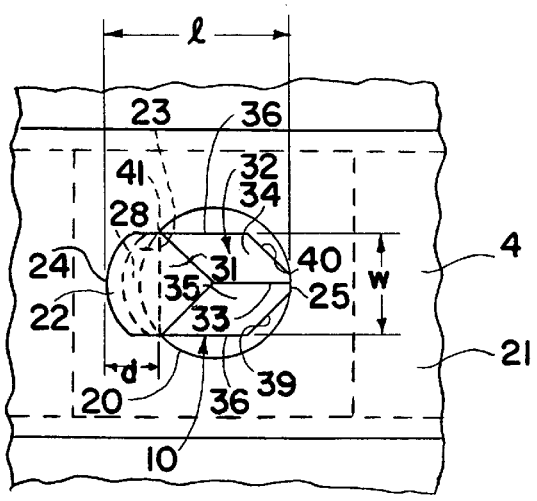
FIG. 9 is a fragmentary top plan view of the snap-lock connection of FIG. 8 as generally seen from the plane of the line 9—9 thereof.

By way of example, where the predrilled holes 20 in the top rails 4 have a diameter of approximately 0.875 inch and a wall thickness of approximately 0.125 inch, the locking tabs 10 have a maximum height h of approximately 0.375 inch, a maximum width w of approximately 0.625 inch and a maximum length l from the front edge 24 of the retaining lips 22 to the rounded back edge 25 of the locking tabs of approximately 1.066 inch (see FIGS. 8 and 9).

The retaining lips 22 are formed by providing an undercut 26 in the bottom front wall of the locking tabs 10 having a maximum depth d from the front edge 24 of the retaining lips of approximately 0.300 inch and a height h' of approximately 0.140 inch. The front edge 24 of the retaining lips 22 has a radius substantially corresponding to the radius of the predrilled holes 20 in the top rail sections 4. Also, the bottom front edge 27 of the retaining lips is beveled at an angle of approximately 30°, leaving a flat surface 28 on the underside of the retaining lips having a depth of approximately 0.223 inch that overlies the inner surface 23 of the bottom wall 21 of the top rail 4 surrounding the predrilled holes 20 when the locking tabs are snapped into the holes 20 as schematically shown in FIGS. 8 through 10.

The front portion 31 of the top wall 32 of the locking tabs 10 including the retaining lips 22 is substantially flat except for the front edge 24 of the retaining lips which is rounded. The rear portion 33 of the top wall 32 of the locking tabs has oppositely sidewardly and rearwardly sloping wall sections 34 and 35 that intersect the side walls 36 at a rearwardly sloping angle and intersect the back wall 37 at its upper edge 38 which has a height of approximately 0.125 inch (i.e., substantially corresponding to the thickness of the bottom wall 21 of the top rail 4). Also, the back wall 37 has a rounded back edge 25 and angled side edges 39 and 40 that intersect the side walls 36 of the locking tabs at an angle of approximately 45°.

The beveled bottom front edge 27 of the retaining lips 22 and beveled top rear wall portion 33 of the locking tabs 10 are important to being able to snap the locking tabs into the holes 20 in the top rails while assuring a tight fit of the locking tabs within the holes. To assemble the balusters 7, 7' to the top rail sections 4, the locking tabs 22 are initially oriented at an angle of approximately 20° to the top rail sections and inserted into the holes until the beveled bottom front edge 27 of the retaining lip 22 just engages the top edge of the holes on one side and the beveled rear top wall portion 33 engages the bottom edge of the holes on the opposite side as schematically shown in FIG. 11. Then the balusters 7, 7' are rotated toward the 90° position (in the direction of the arrow shown in FIG. 11) while pushing the balusters inwardly and forwardly within the holes. This causes the beveled rear top wall portion 33 of the locking tabs to slide forward in the holes until the outer corners 41 (see FIG. 9) of the undercut 26 engage the wall of the holes 20. When this occurs, the rounded back edge 25 of the locking tabs can be forced past the bottom lower edge of the holes 20 to permit the locking tabs to be snapped into the holes with the retaining lips 22 overlying the inner side 23 of the bottom wall 21 of the top rail sections 4 surrounding the holes as schematically shown in FIGS. 8 through 10.

Figure 5:
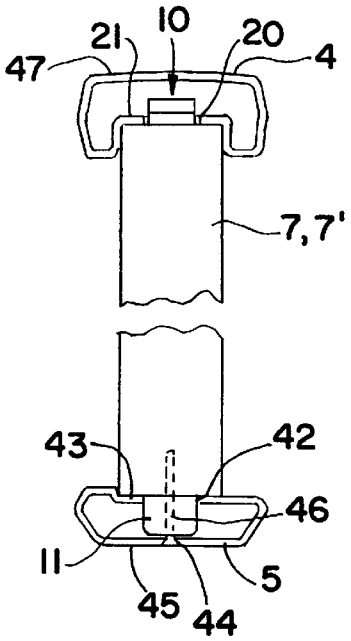
FIG. 5 is a fragmentary vertical section through the rail sections and baluster of FIG. 4, taken generally along the plane of the line 5—5 thereof.
Figure 6:
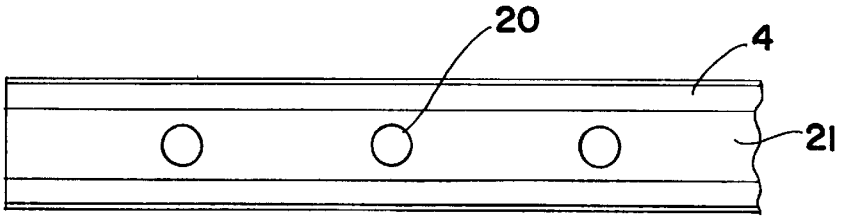
FIG. 6 is a fragmentary bottom plan view of the top rail section of FIGS. 4 and 5.
Figure 10:
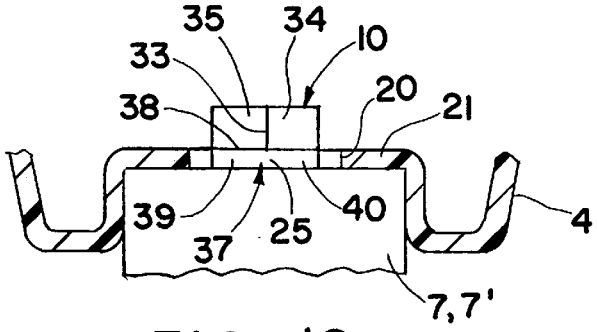
FIG. 10 is a fragmentary transverse section through the snap-lock connection of FIG. 8, taken generally along the plane of the line 10—10 thereof.
Figure 11:
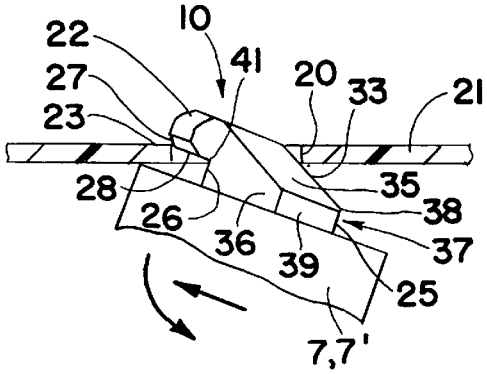
FIG. 11 is a further enlarged fragmentary side elevation view, partly in section, showing the manner in which a locking tab on the top of one of the balusters is angularly inserted into any one of a plurality of predrilled holes in the bottom wall of a top rail section.

The top wall 47 of the top rail sections 4 is desirably radiused as schematically shown in FIG. 5 to facilitate water runoff, whereas the bottom wall 21 is desirably channel shaped to provide enough room and lateral support for the balusters 7, 7' when snap-locked in place as schematically shown in FIGS. 5 and 10.

Figure 4:
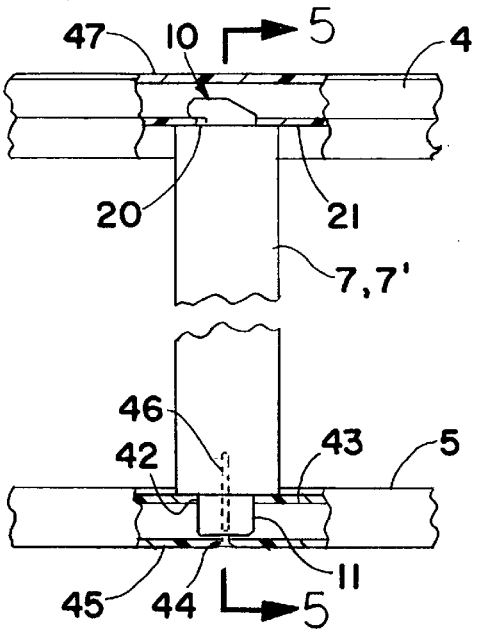
FIG. 4 is an enlarged fragmentary schematic side elevation view, partly in section, showing the attachment between one of the balusters of FIG. 1 and associated top and bottom rail sections.
Figure 7:
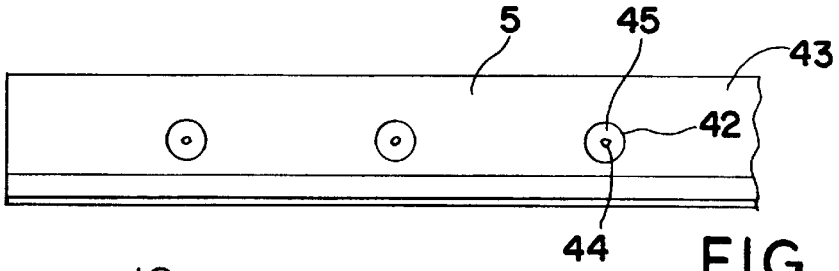
FIG. 7 is a fragmentary top plan view of the bottom rail section of FIGS. 4 and 5.

Predrilled holes 42, shown in FIGS. 4, 5 and 7, are also provided in the top wall 43 of the bottom rail sections 5 for receiving the dowel ends 11 of the balusters 7, 7'. The location of the predrilled holes 42 in the bottom rail sections is the same as the hole locations in the top rail sections 4. In addition, pilot holes 44 are desirably provided in the bottom wall 45 of the bottom rail sections for locating mounting screws 46 in the bottom rail sections for securing the bottom rail sections to the bottom of the balusters as schematically shown in FIGS. 4 and 5. Both holes 42 and 44 may be formed in the bottom rail sections 5 in one pass using, for example, a ⅞ inch diameter bradpoint drill that drills a ⅞ inch hole 42 in the top wall 43 of the bottom rail sections and also drills a 0.100 inch pilot hole 44 in the bottom wall 45 of the bottom rail sections.

Before attaching the balusters 7, 7' to the rail sections 4, 5, the newel posts 6 should be installed to determine the lengths of the railing spans to be used. For safety reasons railing spans should preferably not exceed a maximum of eight feet between newel posts.

Figure 12:
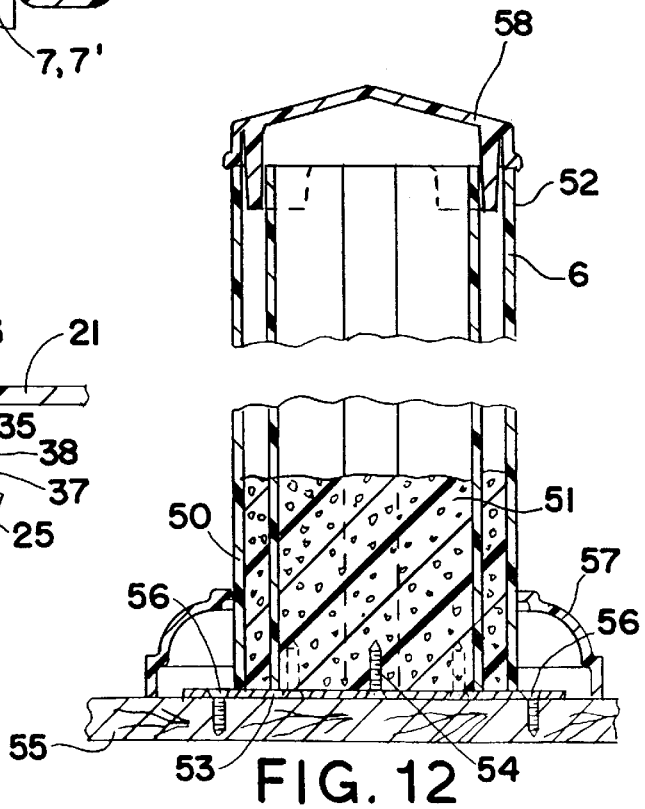
FIG. 12 is an enlarged fragmentary longitudinal section through one of the plastic newel posts of the plastic railing system of FIG. 1 showing the manner of attachment of the newel post to the floor surface.

Approximately the bottom ten inches of the bottom end 50 of each newel post 6 is desirably filled with a rigid high density low pressure plastic foam 51 such as rigid polyurethane foam as schematically shown in FIG. 12. This may be accomplished, for example, by placing the bottom end 50 of the posts against a silicone pad and then pouring enough foam material 51 into the top end 52 to cause the foam material to rise to about ten inches at the bottom end. The top end 52 may be trimmed to make the posts any length desired.

The bottom foamed end 50 allows the posts to be mounted to any type of floor surface using the same basic mounting methods used to attach wood newel posts to such floor surfaces. For example, a metal mounting plate 53 may be centered on the foamed end 50 of the extruded plastic newel post 6 and secured to the post by screws 54 extending through the mounting plate and into the rigid foam material 51 as shown in FIG. 12. Next the mounting plate 53 with newel post 6 attached there may be positioned on the floor surface 55 and secured in place using additional suitable fasteners such as mounting screws 56. Then a plastic trim ring 57 may be slid over the post to cover the mounting plate. The trim ring 57 may be secured to the floor surface 55 using a good quality construction adhesive. Finally, a ball top or pyramid top 58 may be secured to the top of the newel post 6 using a good quality construction adhesive.

Once the newel posts 6 are properly installed and the length of the railing spans are accurately determined, the rail sections 4, 5 are cut to length by removing one-half of the material to be removed from each end of the rail sections. This will maintain the center spacing of the balusters and alignment between the top and bottom rail sections.

Next the rail sections 4 and 5 and balusters 7 or 7' may be roughly laid out on a mar-proof surface and the balusters attached to the top rail sections 4, one at a time. This is accomplished by orienting the locking tabs 10 at an angle of approximately 20° to the top rail sections and inserting the tapered bottom front edge 27 of the retaining lips 22 into engagement with the inner edge of the holes 20 in the top rail sections and swinging the balusters back to 90° while exerting a light inward and forward pressure on the balusters to cause the locking tabs to snap into place with the retaining lips 22 overlying the inner side 23 of the bottom wall 21 of the top rail sections surrounding the holes in the manner previously described.

Next the bottom rail sections 5 are positioned so that the dowels 11 at the bottom of the balusters 7, 7' extend into the predrilled holes 42 in the top wall 43 of the bottom rail sections and screws 46 are inserted through the pilot holes 44 in the bottom wall 45 of the bottom rail sections and into the dowels 11 to secure the bottom rail sections to the balusters.

Figure 14:
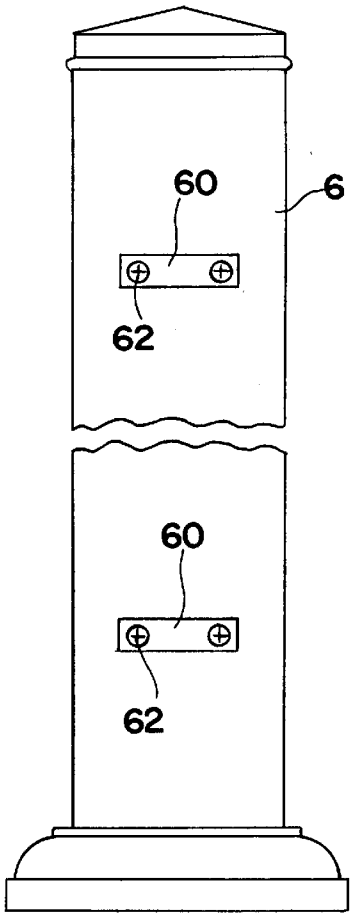
FIG. 14 is a fragmentary front elevation view of the newel post and attachment blocks of FIG. 13.
Figure 13:
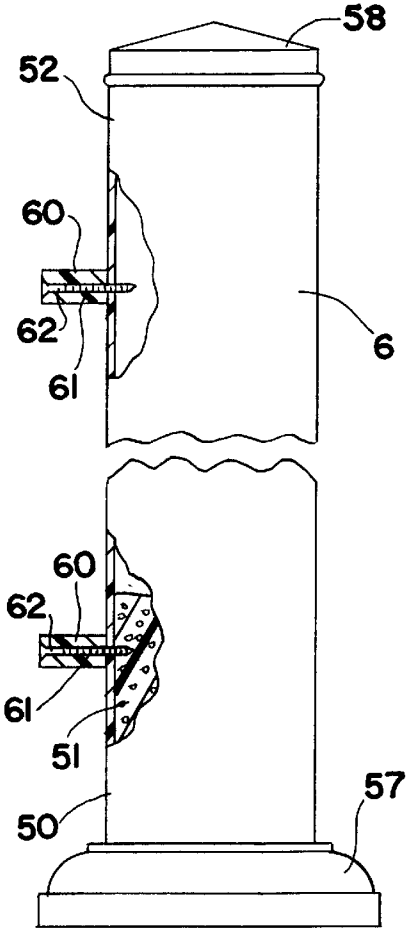
FIG. 13 is an enlarged fragmentary side elevation view of a newel post, partly in section, to show how rail attachment blocks are mounted to the newel posts.

Now the ends of both rail sections 4, 5 are ready to be attached to the newel posts 6. This is preferably done in accordance with the present invention by measuring and marking the location of the rail sections 4 and 5 on the newel posts 6 and securing solid plastic attachment blocks 60 to the posts at each of these locations as schematically shown in FIGS. 13 and 14. The attachment blocks 60 are desirably extruded out of a suitable plastic such as high density polyethylene and are sized to have a close sliding fit within the hollow ends of the rail sections. By way of example, the attachment blocks 60 may be approximately ½ inch thick by 2 inches wide and 1 inch long. Also, the attachment blocks 60 desirably have a pair of spaced apart, longitudinally extending predrilled holes 61 extending lengthwise of the attachment blocks for receipt of two self-tapping screws 62 that are used to secure the attachment blocks to the posts.

Figure 16:
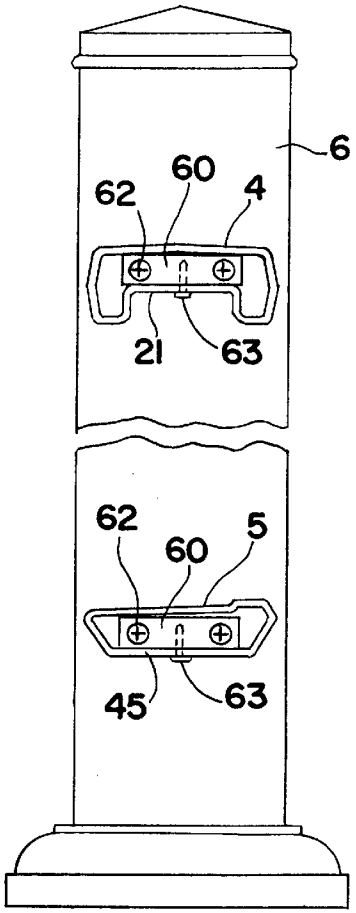
FIG. 16 is a fragmentary front elevation view, partly in section, of the newel post, attachment blocks and rail sections of FIG. 15.
Figure 15:
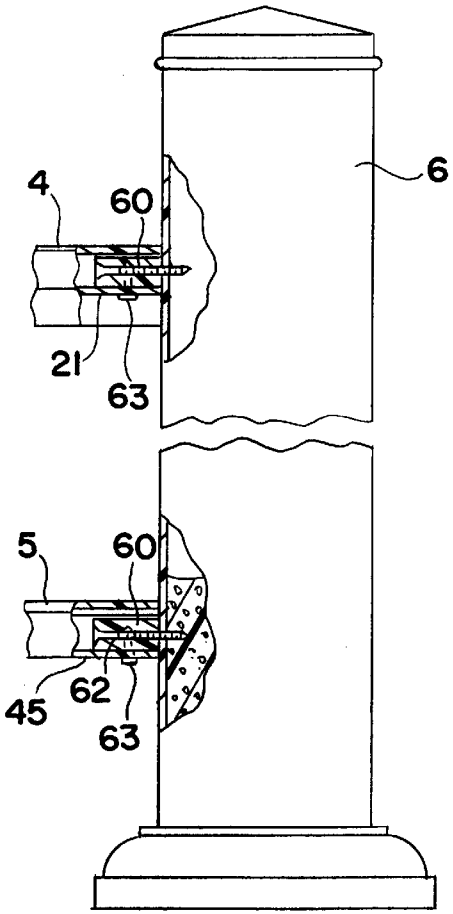
FIG. 15 is an enlarged fragmentary side elevation view, partly in section, of the newel post and attachment blocks of FIG. 13 and further showing the top and bottom rail sections attached to the newel post by means of the attachment blocks.

Next the ends of the top and bottom rail sections 4 and 5 are slid over the attachment blocks 60 on one of the newel posts 6 so the attachment blocks are concealed by the rail sections as schematically shown in FIGS. 15 and 16 and the rail sections are either bowed slightly or the newel posts are pushed slightly apart so that the other end of the rail sections may be slid over the attachment blocks on the next newel post. Thereafter the ends of both rail sections 4, 5 may be secured to the attachment blocks 60 by driving another self-tapping screw 63 through the bottom walls 21 and 45 of the rail sections and into the respective attachment blocks as further shown in FIGS. 15 and 16.

Figure 17:
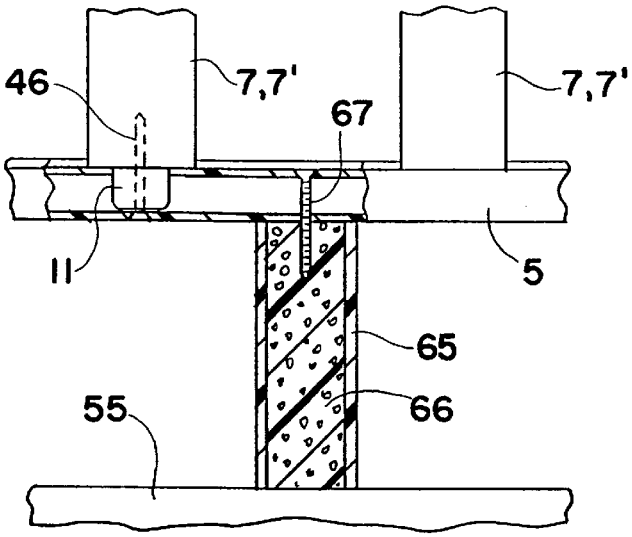
FIG. 17 is a further enlarged fragmentary side elevation view, partly in section, showing how the bottom rail section of FIG. 1 is supported on the deck or porch surface by a plastic support block positioned near the center of the bottom rail span midway between two balusters.

If needed, extruded hollow plastic support blocks 65 having a rigid plastic foam core 66 made for example of rigid high density low pressure polyurethane foam may be positioned near the center of each bottom rail span 5 midway between two balusters 7, 7' and secured to the bottom rail span as by driving a screw 67 through both walls of the bottom rail sections into the foam core 66 of the support blocks as schematically shown in FIG. 17. Although not necessary, the support blocks 66 may also be secured to the deck or porch surface 55 if desired.

In those instances where the railing system 1 is also to extend down stairs 3 as schematically shown in FIG. 1, the required number of newel posts 6 should be installed first in the manner previously described so that the length and rake angle of the railing spans 4 and 5 for the stairs can be accurately determined. One-half of the material to be removed should be cut off each end of the stair rail sections 4, 5 at the required rake angle to maintain the center spacing of the rake balusters 8 and maintain alignment between the rail sections. Likewise, the rake balusters 8 should be cut to the required length and rake angle.

Plain square rake balusters 8 may be made from the plain square extruded hollow plastic balusters 7 by filling the balusters 7 with a rigid high density foam material 70 (see FIG. 18) such as high density rigid polyurethane foam and cutting the foamed balusters to finished lengths. Likewise, colonial rake balusters 8 may be made from the gas assisted injection molded balusters 7' by cutting off the top ends of the colonial balusters 7' to allow the balusters to be filled with a high density rigid foam material such as high density (e.g., twenty pound density) polyurethane foam. The bottom ends 11 of the colonial rake balusters 7' are desirably left intact during filling of the balusters with foam material for ease of filling, and need not be removed until the contractor cuts off both ends to establish the required length and rake angle. One-half of the material must be removed from each end of the colonial rake balusters 8 so the turned portion of the balusters is still centered over the finished baluster length.

Figure 21:
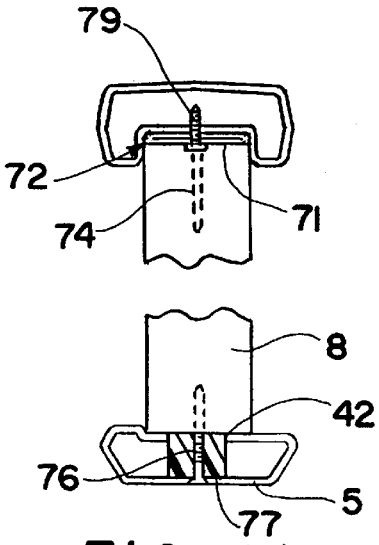
FIG. 21 is a fragmentary vertical section through the top and bottom rail sections of FIG. 20.
Figure 19:
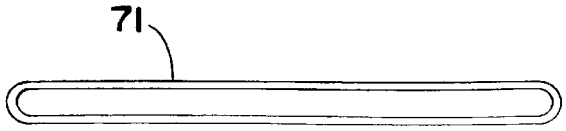
FIG. 19 is a further enlarged transverse section through the fillet strip.

The rake balusters 8 are secured to the top rail sections 4 using a hollow fillet strip 71 cut to the same length as the rail sections. The fillet strip 71 is shown in section in FIG. 19 and may be extruded out of the same fiberglass reinforced plastic material as the rail sections, newel posts and extruded balusters. Also, the fillet strip 71 is dimensioned to closely fit within the channel 72 on the bottom side of the top rail sections 4 as schematically shown in FIG. 21. For example, where the channel on the bottom side of the top rail sections 4 is approximately 1.625 inches wide by 0.500 inch deep, the fillet strips 71 may be approximately 1.575 inches wide and 0.120 inch deep. Also, the fillet strips are desirably externally coated with a suitable thermoplastic material such as polypropylene.

Figure 18:
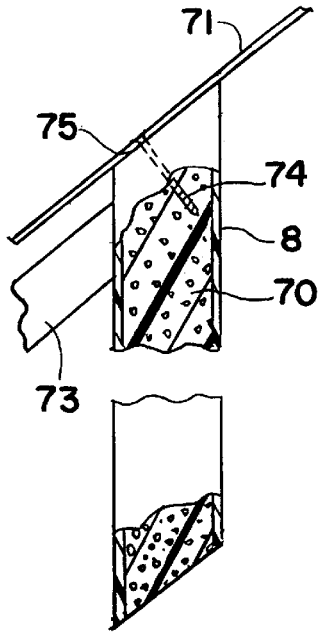
FIG. 18 is en enlarged fragmentary side elevation view, partly in section, showing a fillet strip attached to the upper end of a rake baluster.

To assure proper alignment at the top and bottom of the rake balusters 8, a baluster spacer block 73 (see FIG. 18) may be used. The length of the spacer block 73 will vary depending upon the rake angle of the particular installation, and should correspond to the length needed to maintain proper baluster spacing over the predrilled holes 20 and 42 in both rail sections 4 and 5. Also, the ends of the spacer block should be cut at the required rake angle as schematically shown in FIG. 18.

The rail sections 4, 5, fillet strip 71 and rake balusters 8 may be roughly laid out on a mar-proof surface, and the spacing required from the end of the rail sections to the first rake baluster determined. This spacing, which will vary based on the particular installation, is used to properly locate the starting rake baluster with respect to the end of the fillet strip. Next the fillet strip 71 is attached to the top end of the first rake baluster 8 using a self-tapping screw 74 that extends through both walls of the fillet strip and into the foam 70 within the rake baluster as schematically shown in FIG. 18. During such attachment, it is important to make sure that the edges of the fillet strip 71 are flush with the sides of the balusters 8 in order to prevent interference when fitting the top rail section 4 over the fillet strip 71. Holes 75 in the fillet strip 71 for the self-tapping screws 74 may be predrilled if desired.

Once the first rake baluster 8 has been properly attached to the fillet strip 71, the remaining rake balusters are located along the fillet strip using the spacer block 73 and attached in place using self-tapping screws 74 extending through the fillet strip and into the foam 70 in the rake balusters 8 as before.

Next the bottoms of the rake balusters 8 are attached to the bottom rail sections 5 by driving self-tapping screws 76 through the pilot holes 44 in the bottom wall of the bottom rail sections and into the foam portion 70 of the rake balusters using the same starting rake baluster dimension to locate the starting baluster on the bottom rail sections. Before driving the screws 76 through the bottom wall of the bottom rail sections, plastic spacers 77 may be inserted through the predrilled holes 42 in the top wall of the bottom rail sections into engagement with the bottom wall as schematically shown in FIGS. 20 and 21 to prevent the bottom rail sections from collapsing should over-tightening of the screws occur.

Figure 20:
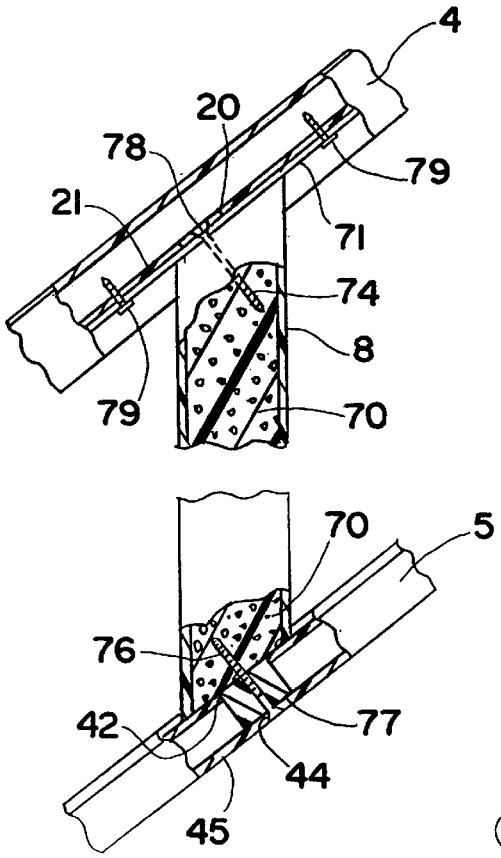
FIG. 20 is an enlarged fragmentary side elevation view, partly in section, showing top and bottom rail sections attached to the fillet strip and rake baluster combination of FIG. 18.

The top rail sections 4 are then placed over the fillet strips 71 and upper ends of the rake balusters 8 with the protruding heads 78 of the screws 74 in alignment with and extending into the predrilled holes 20 in the bottom wall 21 of the top rail sections 4 as schematically shown in FIG. 20. Then the fillet strips 71 are secured to the top rail sections by driving self-tapping screws 79 through the fillet strips between each baluster and into the bottom wall of the top rail sections as further shown in FIGS. 20 and 21.

Now the ends of the rail sections 4, 5 are ready to be attached to the newel posts 6 using concealed attachment blocks 80 having substantially the same dimensions as the attachment blocks 60 previously described. However, since one end of the attachment blocks 80 must be cut or sanded to the desired rake angle of the particular installation, the rake angle attachment blocks 80 are desirably made somewhat longer than the straight baluster attachment blocks 60, for example, 1 ½ inches long instead of 1 inch long.

Figure 22:
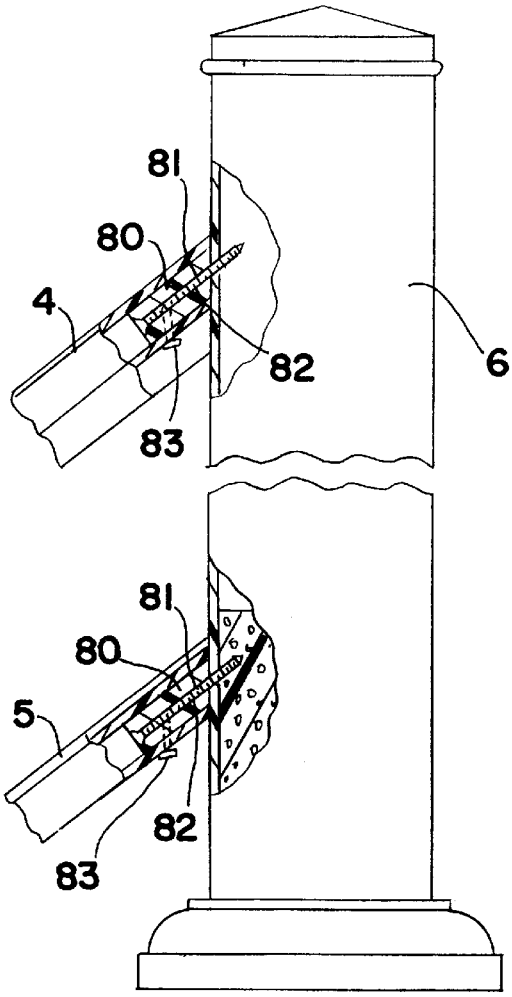
FIG. 22 is an enlarged fragmentary side elevation view, partly in section, showing the top and bottom rail sections of FIGS. 20 and 21 attached to a newel post using angled attachment blocks.
Figure 23:
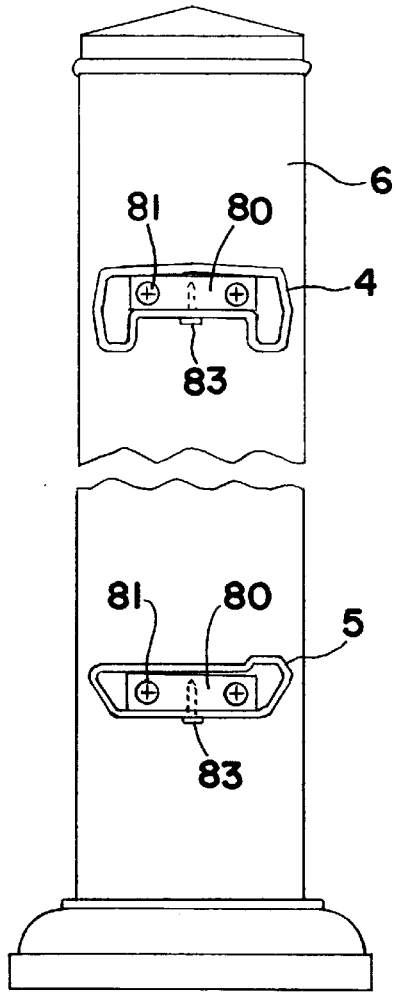
FIG. 23 is a fragmentary front elevation view, partly in section, of the newel post, attachment blocks and rail sections of FIG. 22.

The rake attachment blocks 80 are secured to the newel posts 6 at the desired location of the railing sections using two self-tapping screws 81 inserted through predrilled holes 82 in the attachment blocks as before (see FIG. 22). Next one end of the top and bottom rail sections 4, 5 is slid over the attachment blocks 80 on one of the newel posts 6 (so that the attachment blocks are concealed), and the rail sections are either bowed slightly or the one newel post and next newel post are pushed slightly apart so that the other end of the rail sections may be positioned over the opposite attachment blocks. Thereafter both rail sections 4, 5 may be secured at their ends to the respective attachment blocks 80 as by driving self-tapping screws 83 through the bottom wall of each rail section and into the respective attachment blocks as schematically shown in FIGS. 22 and 23.

From the foregoing, it will now be apparent that the plastic porch or deck railing systems of the present invention are relatively easy to install using concealed attachments between most mating parts.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A newel post for a porch or deck railing system comprising an extruded hollow fiberglass reinforced plastic member having a lower end completely filled with a high density plastic foam material that completely closes said lower end, and a mounting plate secured to said lower end by fasteners extending through said mounting plate into said foam material, said mounting plate extending radially outwardly beyond said member, and mounting holes extending through said mounting plate radially outwardly of said member for receipt of fasteners for attaching said mounting plate to a floor surface.

2. The post of claim 1 further comprising a plastic trim ring surrounding said member and covering said mounting plate, and a plastic top covering an upper open end portion of said member.

3. A baluster for a porch or deck railing system comprising an elongated hollow plastic member having a locking tab extending axially outwardly from one end adapted to be snap locked into a hole in a bottom wall of a top rail section of the railing system, said locking tab having a retaining lip protruding radially outwardly from a front edge only of said locking tab adapted to overlie an inner surface of the bottom wall of the top rail section surrounding the hole in which the locking tab is received, said retaining lip being formed by an undercut on a bottom front edge of said locking tab having a depth slightly greater than the wall thickness of the hole in which the locking tab is adapted to be received, said locking tab having a rounded back edge having a height substantially corresponding to the wall thickness of the hole, said rounded back edge being adapted to substantially engage the wall of the hole when said locking tab is fully inserted in the hole with the retaining lip overlying the inner surface of the bottom wall of the top rail section surrounding the hole.

4. The baluster of claim 3 wherein said undercut has outer corners that are adapted to engage the wall of the hole when the locking tab is fully seated within the hole.

5. The baluster of claim 4 wherein said locking tab has a beveled top rear wall portion intersecting said back edge that aids in causing said locking tab to slide forwardly along a bottom edge of the hole during insertion of the locking tab into the hole.

6. The baluster of claim 5 wherein said locking tab has straight, parallel side walls, and top wall sections that slope sidewardly and rearwardly in opposite directions from said beveled top rear wall portion and intersect said side walls at rearwardly sloping angles.

7. The baluster of claim 5 wherein said locking tab has opposite side edges extending forwardly from said rounded back edge and intersecting said side walls at angles of approximately 45°.

8. The baluster of claim 3 wherein said retaining lip has a bottom front edge that is radially and axially outwardly beveled to aid the retaining lip in clearing an inner edge of the hole during insertion of the locking tab into the hole.

9. The baluster of claim 8 wherein said retaining lip has a radial flat surface inwardly of said beveled bottom front edge that overlies the inner surface of the bottom wall of the top rail section surrounding the hole when the locking tab is fully seated within the hole.

10. The baluster of claim 3 wherein said elongated hollow plastic member is extruded out of a thermoplastic material, and said locking tab is integrally molded on an end cap that is attached to said one end of said member.

11. The baluster of claim 10 wherein said member is gas assisted injection molded with said locking tab integrally molded on said one end of said member.

12. A railing system for a deck or porch comprising top and bottom plastic rail sections, and plastic balusters extending between said rail sections, said top rail section having a bottom wall containing a plurality of longitudinally spaced holes, and said plastic balusters having locking tabs on one end adapted to be snap locked into said holes, said locking tabs having retaining lips protruding from front edges of said locking tabs adapted to overlie an inner surface of said bottom wall of said top rail section surrounding said holes when said locking tabs are fully seated within said holes, said retaining lips having beveled bottom front edges to aid said retaining lips in clearing an inner edge of said holes during insertion of said locking tabs into said holes, said retaining lips being formed by undercuts on bottom front edges of said locking tabs, said undercuts having a depth slightly greater than the wall thickness of said holes in said top rail section, said locking tabs having rounded back edges having a height substantially corresponding to the wall thickness of said holes, and said undercuts having outer corners, said back edges and said outer corners substantially engaging the walls of said holes when said locking tabs are fully seated within said holes.

13. The railing system of claim 12 wherein said retaining lips have flat surfaces inwardly of said beveled bottom front edges that overlie the inner surface of the bottom wall of said top rail section surrounding said holes when said locking tabs are fully seated within said holes.

14. The railing system of claim 12 wherein said locking tabs have beveled top rear wall portions intersecting said back edges that aid in causing said locking tabs to slide forwardly along a bottom edge of said holes during insertion of said locking tabs into said holes.

15. The railing system of claim 14 wherein said locking tabs have straight, parallel side walls, and top wall sections that slope sidewardly and rearwardly in opposite directions from said beveled top rear wall portions and intersect said side walls at rearwardly sloping angles.

16. The railing system of claim 14 wherein said locking tabs have opposite side edges extending forwardly from said rounded back edges and intersecting said side walls at angles of approximately 45°.

17. A railing system comprising extruded hollow fiberglass reinforced plastic top and bottom rail sections connected together by plastic balusters extending therebetween, and a pair of laterally spaced vertical posts attached to mounting surfaces, each of said posts having a pair of vertically spaced plastic attachment blocks attached to said posts, and said rail sections having opposite end portions extending over said attachment blocks and secured thereto, and an extruded hollow plastic support block interposed between said bottom rail section and a mounting surface intermediate two of said balusters, said support block having a rigid high density plastic foam core, and fasteners extending through said bottom rail section into said foam core.

18. A railing system comprising extruded hollow fiberglass reinforced plastic top and bottom rail sections connected together by plastic balusters extending therebetween, and a pair of laterally spaced vertical posts attached to mounting surfaces, each of said posts having a pair of vertically spaced plastic attachment blocks attached to said posts, and said rail sections having opposite end portions extending over said attachment blocks and secured thereto, the mounting surface for one of said posts being at a higher elevation than the mounting surface for the other of said posts, and said rail sections having opposite end portions cut at an angle corresponding to a predetermined slope of said rail sections between said posts, said attachment blocks extending at an angle from said posts corresponding to the predetermined slope of said rail sections between said posts, and said balusters having opposite end portions cut at a rake angle corresponding to the predetermined slope of said rail sections, said balusters being hollow and having a rigid high density plastic foam core, and an extruded fiberglass reinforced plastic fillet strip secured to upper ends of said balusters by fasteners extending through said fillet strip into said foam core in said upper ends, and additional fasteners extending through said fillet strip into a bottom wall of said top rail section intermediate said balusters for securing said balusters to said bottom wall.

19. The railing system of claim 18 further comprising additional fasteners extending through said bottom rail section into said foam core in lower ends of said balusters for securing said bottom rail section to said balusters.

20. The railing system of claim 18 wherein said top rail section has longitudinally spaced predrilled holes in said bottom wall corresponding to the spacing of said balusters along said rail sections, said fasteners used to attach said fillet strip to said balusters having protruding heads received in said predrilled holes in said bottom wall of said top rail section.

21. The railing system of claim 20 wherein said bottom rail section has a top wall containing longitudinally spaced predrilled holes corresponding to the longitudinal spacing of said predrilled holes in said top rail section, and a bottom wall containing pilot holes in coaxial alignment with said predrilled holes in said top wall of said bottom rail section for locating the fasteners used to secure said bottom rail section to said balusters.

22. The railing system of claim 21 further comprising plastic spacers extending through said predrilled holes in said top wall of said bottom rail section into engagement with said bottom wall of said bottom rail section to prevent said bottom rail section from collapsing during tightening of the fasteners used to secure said bottom rail section to said balusters.

23. A baluster for a porch or deck railing system comprising an elongated hollow plastic member having a locking tab on one end adapted to be snap locked into a hole in a bottom wall of a top rail section of the railing system, said locking tab having a rigid retaining lip protruding radially outwardly from a front edge only of said locking tab adapted to overlie an inner surface of the bottom wall of the top rail section surrounding the hole in which the locking tab is received, said locking tab having a rounded back edge having a height substantially corresponding to the wall thickness of the hole and a beveled top rear wall portion intersecting said back edge and straight, parallel side walls and top wall sections that slope sidewardly and rearwardly in opposite directions from said beveled top rear wall portion and intersect said side walls at a rearwardly sloping angle, and said retaining lip having a bottom front edge that is beveled.

24. The baluster of claim 23 wherein said locking tab has opposite side edges extending from said rounded back edge and intersecting said side walls at angles of approximately 45°.

25. A railing system comprising extruded hollow fiberglass reinforced plastic top and bottom rail sections connected together by plastic balusters extending therebetween, and a pair of spaced posts, said rail sections having opposite end portions attached to said posts, each of said posts comprising an extruded hollow fiberglass reinforced plastic member having a lower end completely filled with a high density plastic foam material that completely closes said lower end, and a mounting plate secured to said lower end by fasteners extending through said mounting plate into said foam material, said mounting plate extending radially outwardly beyond said member, and mounting holes extending through said mounting plate radially outwardly of said member for receipt of fasteners for attaching said mounting plate to a mounting surface.

26. The railing system of claim 25 further comprising a pair of vertically spaced solid plastic attachment blocks attached to said posts, said rail sections having opposite end portions extending over said attachment blocks and secured thereto.

27. The railing system of claim 26 further comprising fasteners extending through bottom walls of said rail sections into said attachment blocks for securing said rail sections to said attachment blocks.

28. The railing system of claim 27 wherein said attachment blocks have predrilled holes extending longitudinally through said attachment blocks, and fasteners extend through said predrilled holes into said posts for securing said attachment blocks to said posts.

29. The railing system of claim 26 wherein the mounting surface for one of said posts is at a higher elevation than the mounting surface for the other of said posts, and said rail sections have opposite end portions cut at an angle corresponding to a predetermined slope of said rail sections between said posts, said attachment blocks extending at an angle from said posts corresponding to the predetermined slope of said rail sections between said posts, and said balusters having opposite end portions cut at a rake angle corresponding to the predetermined slope of said rail sections.

* * * * *